US011056809B2

(12) United States Patent
Kim

(10) Patent No.: US 11,056,809 B2
(45) Date of Patent: Jul. 6, 2021

(54) VERTICAL-TYPE DIRECT PCB CONNECTOR

(71) Applicant: LG Chem, Ltd., Seoul (KR)

(72) Inventor: Sung-Gyu Kim, Daejeon (KR)

(73) Assignee: LG Chem, Ltd.

( * ) Notice: Subject to any disclaimer, the term of this patent is extended or adjusted under 35 U.S.C. 154(b) by 0 days.

(21) Appl. No.: 16/649,869

(22) PCT Filed: Apr. 8, 2019

(86) PCT No.: PCT/KR2019/004165

§ 371 (c)(1),
(2) Date: Mar. 23, 2020

(87) PCT Pub. No.: WO2019/216553

PCT Pub. Date: Nov. 14, 2019

(65) Prior Publication Data

US 2020/0259281 A1 Aug. 13, 2020

(30) Foreign Application Priority Data

May 8, 2018 (KR) ..... 10-2018-0052653

(51) Int. Cl.
*H01R 12/71* (2011.01)
*H01R 12/70* (2011.01)
(Continued)

(52) U.S. Cl.
CPC ..... *H01R 12/714* (2013.01); *H01R 12/7023* (2013.01); *H01R 13/2442* (2013.01); *H01R 13/432* (2013.01); *H01R 13/502* (2013.01)

(58) Field of Classification Search
CPC ..... H01R 12/7023; H01R 13/2442; H01R 13/502; H01R 13/432; H01R 13/66; H01R 12/714
(Continued)

(56) References Cited

U.S. PATENT DOCUMENTS 4,668,040 A * 5/1987 Matsuzaki ..... H01R 12/7029 439/557
5,257,948 A * 11/1993 Peterson ..... H01R 12/7029 439/571
(Continued)

FOREIGN PATENT DOCUMENTS

CN 206685558 U 11/2017
JP H01142167 U 9/1989
(Continued)

OTHER PUBLICATIONS

International Search Report from Application No. PCT/KR2019/004165 dated Jul. 26, 2019, 2 pages.
(Continued)

*Primary Examiner* — Peter G Leigh
(74) *Attorney, Agent, or Firm* — Lerner, David, Littenberg, Krumholz & Mentlik, LLP

(57) ABSTRACT

A vertical-type direct printed circuit board (PCB) connector including a connector housing directly mounted to one surface of a PCB substrate in a vertical type, and bending terminal members installed inside the connector housing and having one side extending in a first direction corresponding to a direction perpendicular to the one surface of the PCB substrate to be connected to a signal transmission cable and the other side extending in a second direction corresponding to a length direction of contact pads provided to the one surface of the PCB substrate to be connectable to the contact pads.

10 Claims, 8 Drawing Sheets

(51) Int. Cl.
*H01R 13/24* (2006.01)
*H01R 13/432* (2006.01)
*H01R 13/502* (2006.01)

(58) Field of Classification Search
USPC ..... 439/329
See application file for complete search history.

(56) References Cited

U.S. PATENT DOCUMENTS 5,951,325 A * 9/1999 Tang ..... H01R 12/7029 439/567
6,053,767 A * 4/2000 Copper ..... H01R 12/7029 439/567
6,095,822 A 8/2000 Corisis et al.
6,152,742 A 11/2000 Cohen et al.
6,478,623 B1 * 11/2002 Wu ..... H01R 13/6582 439/607.35
6,638,105 B1 * 10/2003 Wu ..... H01R 12/7029 439/567
6,860,765 B1 * 3/2005 Spink, Jr. ..... H01R 12/716 439/680
7,320,619 B2 * 1/2008 Takahashi ..... H01R 12/7017 439/567
7,351,091 B1 * 4/2008 Zhang ..... H01R 12/57 439/405
7,597,576 B2 * 10/2009 Zhang ..... H01R 12/7029 439/299
7,997,922 B2 * 8/2011 Dawiedczyk ..... H01R 12/7005 439/357
8,109,790 B2 * 2/2012 He ..... H01R 12/707 439/607.35
8,137,131 B2 * 3/2012 Wang ..... H01R 12/725 439/570
8,177,581 B2 * 5/2012 Zeng ..... H01R 12/7052 439/567
8,257,114 B2 * 9/2012 Wang ..... H01R 12/57 439/607.01
8,262,414 B1 * 9/2012 Li ..... H01R 13/6273 439/607.35
8,465,299 B2 * 6/2013 Ho ..... H01R 13/506 439/79
9,048,581 B2 * 6/2015 Briant ..... H01R 13/4361
9,190,783 B2 * 11/2015 Chang ..... H01R 12/7052
2007/0049072 A1 * 3/2007 Sato ..... H01R 12/7052 439/79
2009/0111330 A1 * 4/2009 Lin ..... H01R 12/7023 439/638
2011/0070762 A1 3/2011 Hiramatsu
2013/0040505 A1 2/2013 Hirakawa
2013/0273782 A1 10/2013 Muro
2014/0087572 A1 3/2014 Saur et al.
2015/0118887 A1 * 4/2015 Katayanagi ..... H01R 13/6582 439/353
2015/0214647 A1 7/2015 Sha et al.
2017/0294725 A1 * 10/2017 Kang ..... H01R 12/716
2017/0294726 A1 * 10/2017 Tsai ..... H01R 13/6581
2018/0034175 A1 * 2/2018 Lloyd ..... H01R 12/71
2018/0287269 A1 10/2018 Ju
2019/0190172 A1 * 6/2019 Fu ..... H01R 12/7005

FOREIGN PATENT DOCUMENTS

JP H11506256 A 6/1999
JP 2008112682 A 5/2008
JP 2010262854 A 11/2010
JP 201170776 A 4/2011
JP 2012138183 A 7/2012
KR 200308173 Y1 3/2003
KR 20120086735 A 8/2012
KR 20130135308 A 12/2013
KR 20160001516 A 1/2016
KR 101801706 B1 12/2017

OTHER PUBLICATIONS

Chinese Search Report including Office Action for Application No. 2019300016478, dated Feb. 9, 2021, 8 pages.

* cited by examiner

VERTICAL-TYPE DIRECT PCB CONNECTOR

CROSS-REFERENCE TO RELATED APPLICATIONS

The present application is a national phase entry under 35 U.S.C. § 371 of International Application No. PCT/KR2019/004165 filed Apr. 8, 2019, published in Korean, which claims priority from Korean Patent Application 10-2018-0052653 filed May 8, 2018, all of which are incorporated herein by reference.

TECHNICAL FIELD

The present disclosure relates to a connector for connection with a substrate, and more particularly, to a vertical-type direct printed circuit board (PCB) connector capable of being directly coupled to a PCB substrate without a complementary connector in a vertical type.

The present application claims priority to Korean Patent Application No. 10-2018-0052653 filed on May 8, 2018 in the Republic of Korea, the disclosures of which are incorporated herein by reference.

BACKGROUND ART

Recently, electronic devices such as laptops, tablet PCs and smart phones as well as battery management systems (BMS) used for charging or discharging products using secondary batteries have become increasingly compact and lightweight, and accordingly the density of electronic elements mounted to a circuit substrate thereof is also increasing. Thus, there is a demand for light, thin, short and small connector devices.

FIG. 1 is a diagram schematically showing a conventional connector device.

As shown in FIG. 1, a conventional connector device generally includes a female connector 4 and a male connector 5 in a pair. The female connector 4 has a plurality of pins corresponding to a contact, and the male connector 5 has a plurality of plug terminals that come into contact with the plurality of pins. The male connector 5 is mounted to a circuit board 6 by means of SMT (Surface Mounter Technology), and the female connector 4 is complementarily coupled with the male connector 5.

However, if both the female connector 4 and the male connector 5 are used, different bodies and contacts of the female connector 4 and the male connector 5 should be prepared using different molds, and any one connector must be surface-mounted to a circuit board, which makes the manufacturing process complicated and increases the manufacturing cost.

As an alternative to the connector structure, Korean Unexamined Patent Publication No. 10-2012-0086735 discloses a substrate edge connection-type connector, which may directly connect a terminal to a conductive pattern of a circuit substrate while removing a male connector from the circuit substrate. However, in the substrate edge connection-type connector, the connector should be located at an end of the circuit substrate. For this reason, there are problems that the degree of freedom for designing the circuit substrate and the impact resistance of the circuit substrate are low, and the connector is detached just with a small external force.

Thus, there is a demand for a connector device, which may simplify the connector structure and its manufacturing process, allow the connector to be connected to any position on the circuit substrate, and prevent the connector from being detached from or erroneously connected to the substrate due to an external force applied to the substrate, when connecting the connector to the printed circuit board.

SUMMARY

Technical Problem

The present disclosure is directed to providing a connector device, which may simplify a connector structure and its manufacturing process, allow the connector to be connected to any position on a circuit substrate, and prevent the connector from being detached from or erroneously connected to the substrate due to an external force applied to the substrate, when connecting the connector to the printed circuit board.

Technical Solution

In one aspect of the present disclosure, there is provided a vertical-type PCB connector, comprising: a connector housing directly vertically mounted onto a first surface of a PCB substrate; and a plurality of bent terminal members positioned inside the connector housing, each terminal member having a first side extending in a first direction corresponding to a direction perpendicular to the first surface of the PCB substrate, the first side configured to be connected to a signal transmission cable, and an opposing second side extending in a second direction corresponding to a length direction of contact pads formed on the first surface of the PCB substrate, the second side configured to be connected to the contact pads.

The connector housing may include a connector body configured to accommodate the bent terminal members and disposed to contact the first surface of the PCB substrate; and first and second latch members positioned at opposing outer surfaces of the connector body, respectively, and vertically inserted into respective first holes formed in the PCB substrate to be latched to an opposing second surface of the PCB substrate.

Each of the first and second latch members may include a support protruding perpendicularly to the corresponding outer surface of the connector body; and a lever perpendicularly connected to the support and extending in a direction parallel to the corresponding outer surface of the connector body, the lever having a latch at a first end of the lever such that the latch is latched to the second surface of the PCB substrate through the corresponding first hole, and the lever may be provided to perform a seesawing motion based on the support.

The connector housing may further include a lock pin portion extending vertically at a lower end of the connector body, wherein the lock pin portion is configured to contact the first surface of the PCB substrate, and to fit into a second hole formed in the PCB substrate.

The first latch member, the second latch member and lock pin portion may be positioned such that straight lines drawn between central points of each form an isosceles triangular structure with the latch units.

Each bent terminal member may include a terminal body having a vertical portion with a predetermined thickness and extending in the first direction and a horizontal portion intersecting with the vertical portion and extending in the second direction; and a cantilever-type terminal contact having a smaller thickness than the predetermined thickness of the horizontal portion and extending in the second direction from an end of the horizontal portion, the terminal contact having a contact portion curved toward a corresponding contact pad of the PCB substrate.

The connector body may include an inside plate configured to divide an inner space of the connector body along a plane intersecting with the first direction; and a plurality of perforation holes provided at respective locations adjacent to a first side end of the inside plate, each perforation hole adapted to form a tunnel inside the connector body in the first direction, the tunnels formed by the plurality of perforation holes being spaced at predetermined intervals from each other, the vertical portions of the plurality of bent terminal members may be inserted into respective ones of the plurality of perforation holes, and the horizontal portions of the plurality of bent terminal members are disposed in contact with a first surface of the inside plate.

The inside plate may include a barrier disposed between the horizontal portions of the plurality of bending terminal members.

Each bent terminal member may further include an anti-separation pin protruding in a direction opposite to the first direction, forming an acute angle with respect to the vertical portion of the terminal member, and disposed at an opposing second surface of the inside plate.

The vertical-type PCB connector may further comprise a retainer mounted to a lower end of the connector body and configured to support the plurality of terminal bodies of the bent terminal members.

Advantageous Effects

According to an embodiment of the present disclosure, the connector is directly connected to a contact pad on a printed circuit substrate without using a separately complementary connector, thereby simplifying the structure and manufacturing process of the connector and reducing the manufacturing cost.

In addition, since the connector may be vertically mounted with respect to the printed circuit substrate, the connector may be disposed in an area inside the rim of the substrate, thereby increasing the space utilization and the degree of freedom for designing the printed circuit substrate.

According to another embodiment of the present disclosure, it is possible to easily attach or detach the connector to/from the printed circuit substrate and secure rigid fixation in the X-axis, Y-axis and Z-axis directions, thereby preventing the connector from being detached from or erroneously attached to the circuit substrate due to an external force.

It will be clearly understood by those skilled in the art that various embodiments according to the present disclosure can solve various technical problems not mentioned herein.

DETAILED DESCRIPTION

Hereinafter, preferred embodiments of the present disclosure will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present disclosure on the basis of the principle that the inventor is allowed to define terms appropriately for the best explanation.

Therefore, the description proposed herein is just a preferable example for the purpose of illustrations only, not intended to limit the scope of the disclosure, so it should be understood that other equivalents and modifications could be made thereto without departing from the scope of the disclosure.

In the following description, a PCB substrate may refer to a BMS circuit substrate having a BMS chip employed at a battery pack. The BMS controls charge/discharge, cell balancing, and the like of battery cells. The vertical-type PCB connector of the present disclosure may be used to connect to the BMS circuit substrate and transmit voltage information or the like of the battery cells to the BMS. Here, the PCB substrate does not mean only a BMS circuit substrate. That is, the PCB substrate may be a concept including printed circuit substrates used in electronic devices such as laptops, tablet PCs, and smart phones.

Figure 1:
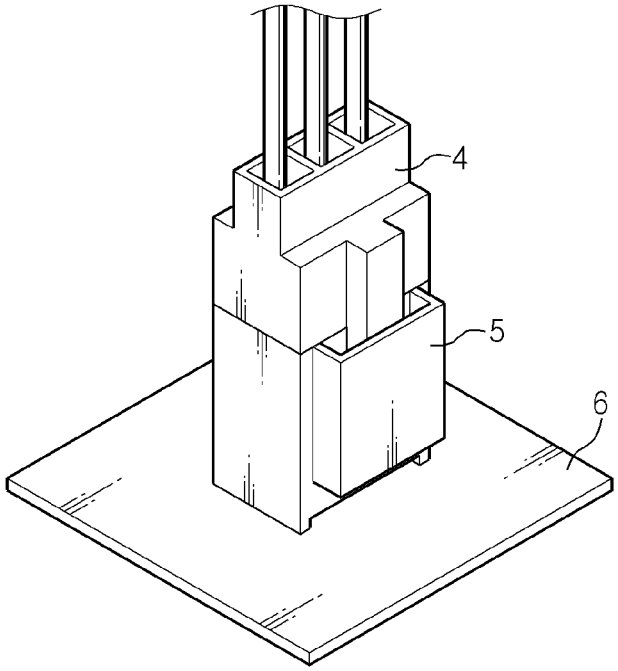
FIG. 1 is a diagram schematically showing a conventional connector device.
Figure 2:
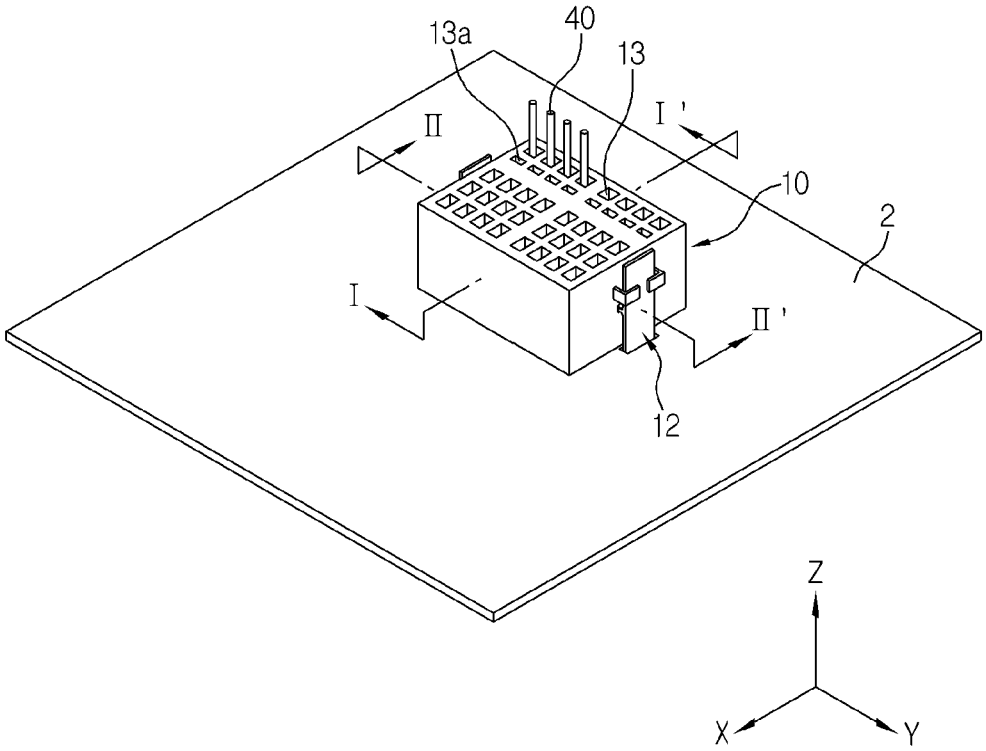
FIG. 2 is a perspective view schematically showing a vertical-type PCB connector according to an embodiment of the present disclosure, which is mounted onto a PCB substrate.
Figure 3:
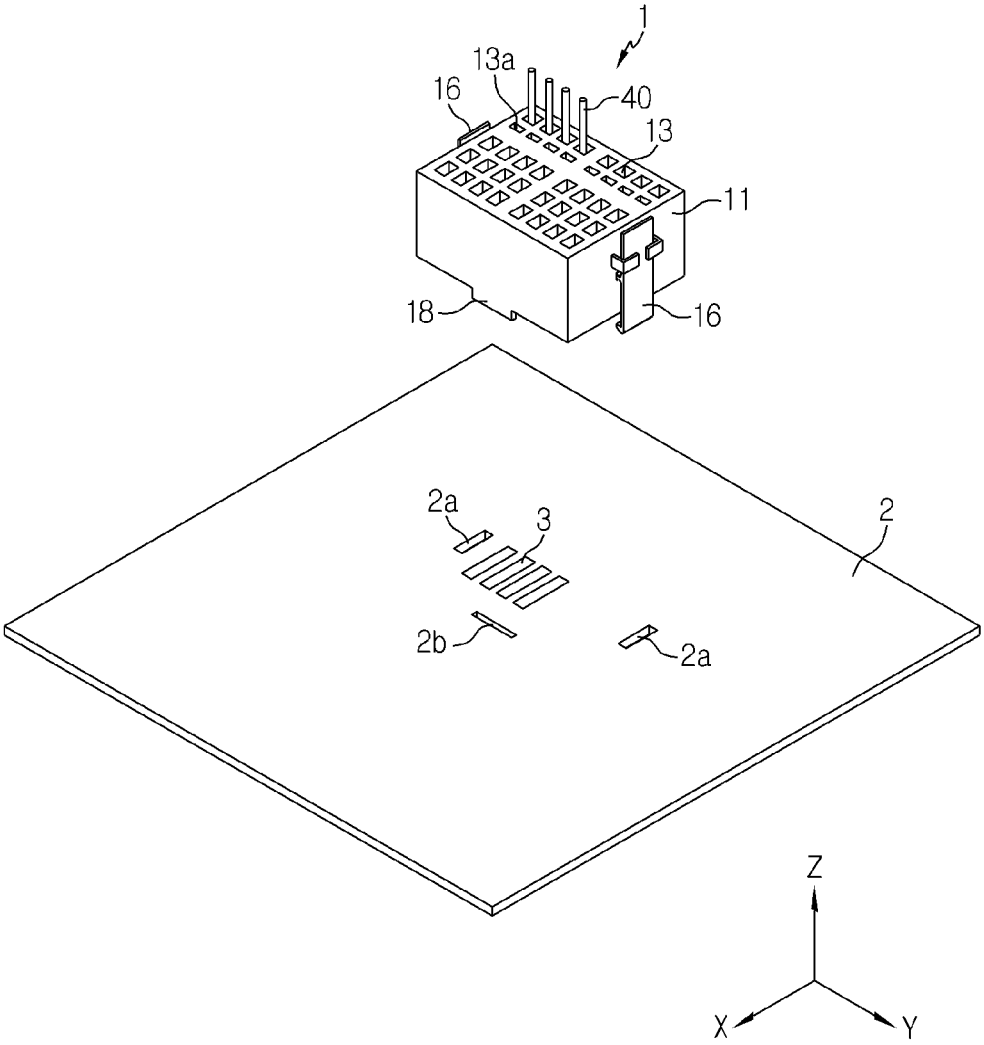
FIG. 3 is a perspective view showing the vertical-type PCB connector of FIG. 2, which is separated from the PCB substrate.
Figure 4:
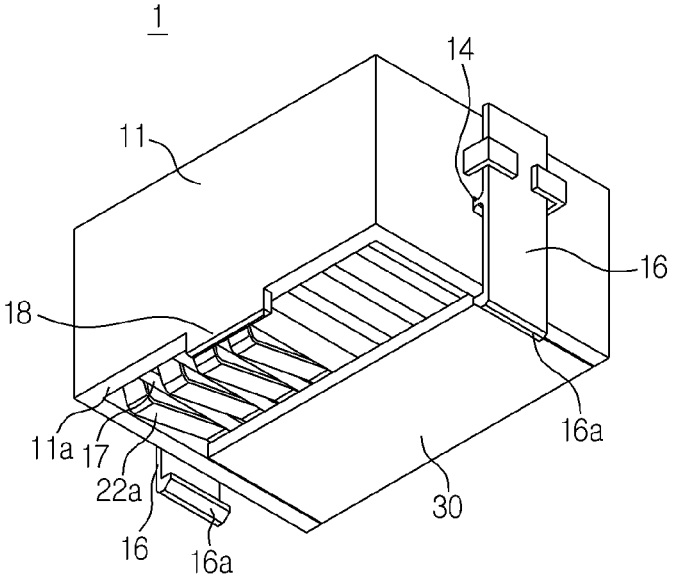
FIG. 4 is a perspective view showing the vertical-type PCB connector of FIG. 3, observed from the below.
Figure 5:
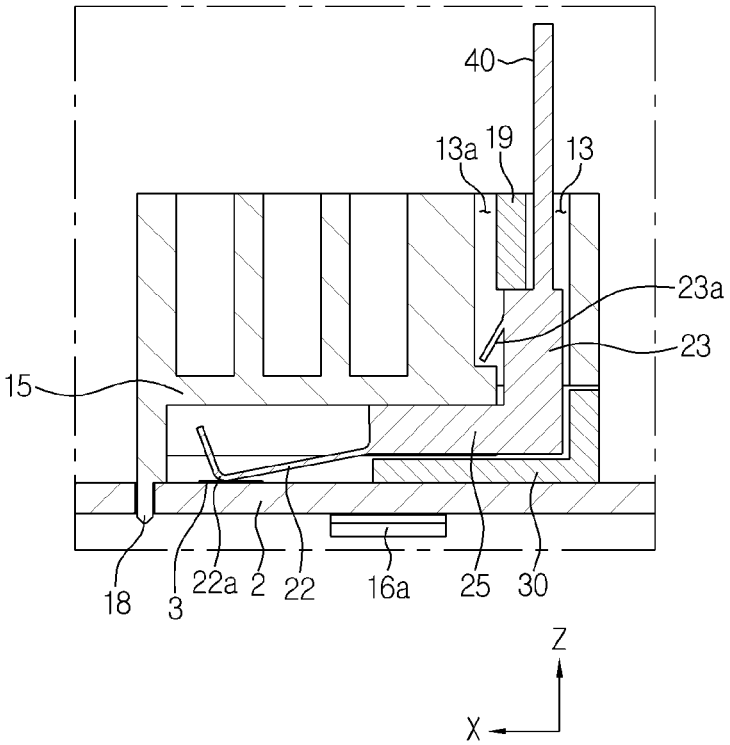
FIG. 5 is a cross-sectional view showing the vertical-type PCB connector, taken along the line I-I' of FIG. 2.

FIG. 2 is a perspective view schematically showing a vertical-type PCB connector according to an embodiment of the present disclosure, which is mounted onto a PCB substrate, FIG. 3 is a perspective view showing the vertical-type PCB connector of FIG. 2, which is separated from the PCB substrate, FIG. 4 is a perspective view showing the vertical-type PCB connector of FIG. 3, observed from the below, and FIG. 5 is a cross-sectional view showing the vertical-type PCB connector, taken along the line I-I' of FIG. 2.

In this specification, a direction orthogonal to one surface of a PCB substrate 2 is defined as a first direction, and a direction corresponding to a length direction of contact pads 3 of the PCB substrate 2 is defined as a second direction. Based on FIGS. 2 and 3, the first direction may be regarded as a +Z-axis direction, and the second direction may be regarded as a +X-axis direction. In addition, the up, down, left, right, front and rear directions are based on a PCB connector that is mounted vertically to one surface of the PCB substrate 2.

Referring to FIGS. 2 to 5, a vertical-type PCB connector 1 according to an embodiment of the present disclosure includes a connector housing 10, bending terminal members 20, and a retainer 30.

The vertical-type PCB connector 1 includes a bending terminal member 20 formed in an approximately "L" shape at an inside of the connector housing 10, and a contact portion 22*a* of the bending terminal member 20 elastically contacts the contact pad 3 of the PCB substrate 2 to be electrically connected to the PCB substrate.

The connector housing 10 is a component directly mounted onto one surface of the PCB substrate 2 in a vertical type and includes a connector body 11 for accommodating the bending terminal members 20 therein and a latch unit 12 and a lock pin portion 18 serving as a means for mounting the connector body 11 to one surface of the PCB substrate 2.

When the connector housing 10 is mounted onto one surface of the PCB substrate 2, a peripheral edge of the rim of the connector body 11 forming a lower end is brought into contact with one surface of the PCB substrate 2. In addition, the connector body 11 has an inner structure where the bending terminal member 20 may be inserted and fixed in a space inside a lower end 11*a* of the connector body (such that only the contact portions 22*a* of the bending terminal members 20 protrudes outer than the lower end 11*a* of the connector body). This will be described later in more detail.

Figure 6:
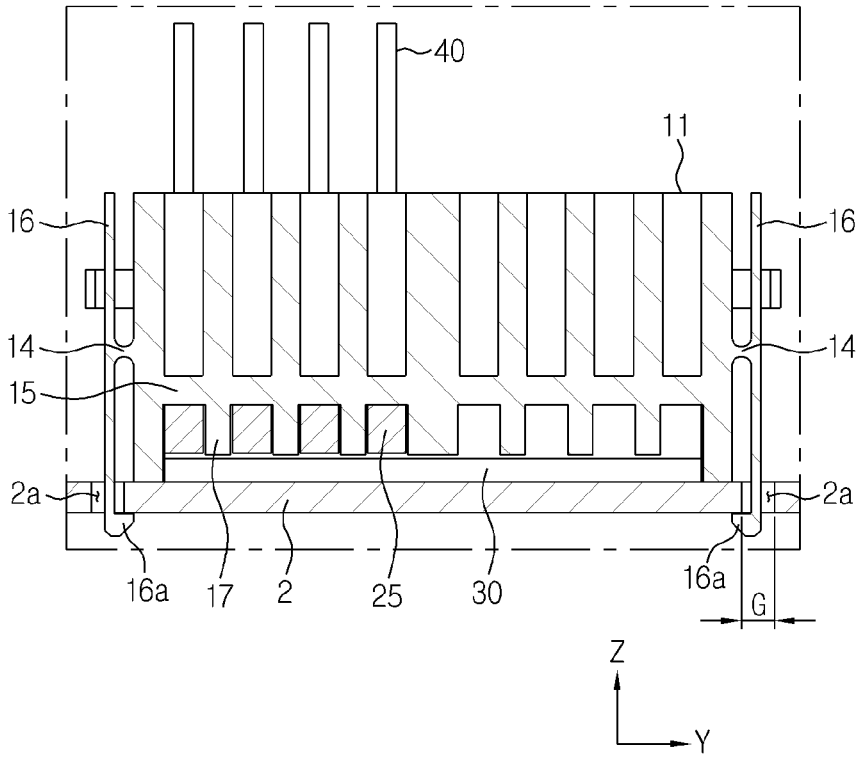
FIG. 6 is a cross-sectional view showing the vertical-type PCB connector, taken along the line II-II' of FIG. 2.
Figure 7:
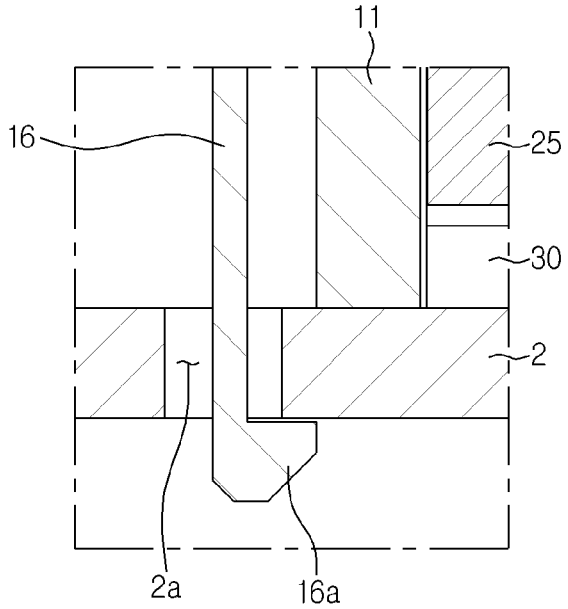
FIG. 7 is an enlarged view showing a latch unit of a lever unit of FIG. 6.

Referring to FIGS. 4 to 6 along with FIG. 7, the latch unit 12 may be symmetrically provided to both outer side surfaces of the connector body 11 facing each other, namely to left and right sides of the connector body 11, one by one, and the latch unit 12 may be inserted perpendicularly into first holes 2*a* provided in the PCB substrate 2 and latched in the vertical direction to the other surface of the PCB substrate 2.

In particular, each of the latch units 12 according to this embodiment includes a support 14 extending perpendicularly to the corresponding outer side surface of the connector body 11, a lever unit 16 connected perpendicularly to the support 14 and vertically extending in parallel to the outer side surface of the connector body 11.

The lever unit 16 has a latch 16*a* at one end and extends to a position lower than the lower end 11*a* of the connector body by a predetermined distance. As shown in FIG. 7, after the lever unit 16 is vertically inserted into the first holes 2*a* provided in the PCB substrate 2, the latch 16*a* may be latched to the other surface of the PCB substrate 2. Since the latch 16*a* of the lever unit 16 is latched to the other surface of the PCB substrate 2 in the vertical direction, the Z-axis direction movement of the connector body 11 with respect to one surface of the PCB substrate 2 may be suppressed.

Figure 8:
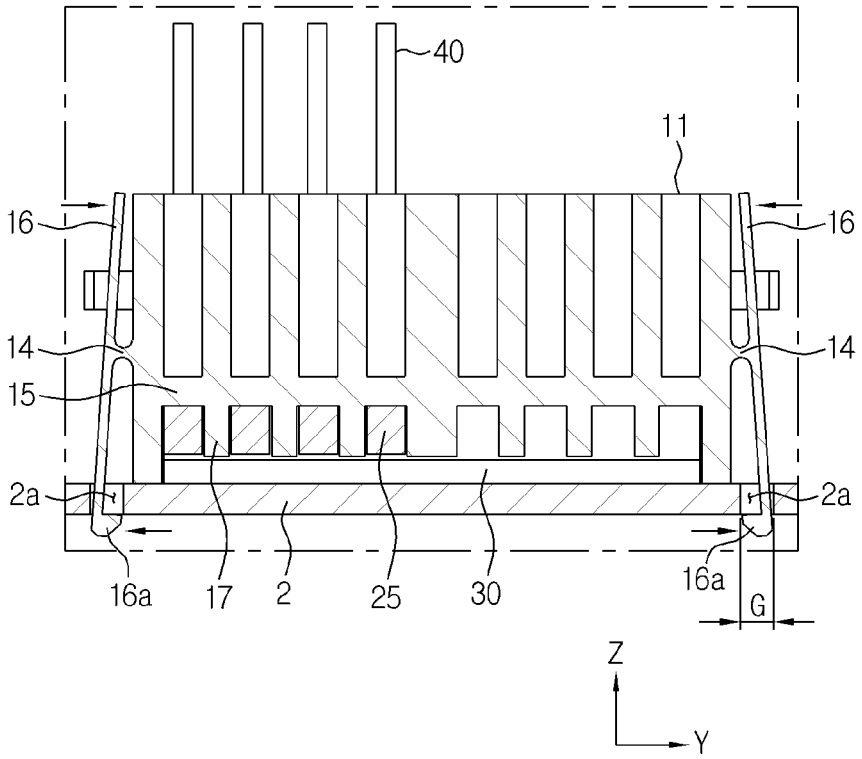
FIG. 8 is a diagram corresponding to FIG. 6 for illustrating a method of detaching the vertical-type PCB connector.

Meanwhile, in the lever unit 16 according to this embodiment, the support 14 is connected to approximately a middle point along the length direction of the lever unit 16. Thus, when the one side end of the lever unit 16 is pressed, the lever unit 16 may make a seesawing motion based on the support 14. That is, as shown in FIG. 8, if the one side end of the lever unit 16 is pressed based on the support 14, the other side end of the lever unit 16 is directed opposite to the pressed direction. In addition, if one side of the lever unit 16 is pressed and then released, the lever unit 16 returns to its original state perpendicular to the support 14. The support 14 and the lever unit 16 may be integrally provided with the connector body 11 using a material capable of elastic restoration within a predetermined load range.

The thickness of the lever unit 16 is smaller than the (Y-axis direction) width of the first hole 2*a*, and the size of the latch 16*a* is almost identical to the width G of the first hole 2*a*. Thus, when the lever unit 16 is inserted into the first hole 2*a*, the location of the latch 16*a* should be aligned with the first hole 2*a* in the vertical direction. For this reason, when the connector housing 10 is mounted onto one surface of the PCB substrate 2, an upper end of the lever units 16 is slightly pressed so that the latch 16*a* is vertically inserted into the first hole 2*a*, and the lever units 16 is released so that the latch 16*a* is latched to the other surface of the PCB substrate 2 while the original position of the lever unit 16 is restored.

When detaching the connector housing 10 from one surface of the PCB substrate 2, in a state where the lever units 16 are pressed in the same manner as the mounting operation, the connector housing 10 is lifted in the +Z-axis direction.

Also, the X-axis direction movement of the connector body 11 may be suppressed by matching the width of the lever unit 16 with the width of one side (X-axis direction) of the first hole 2*a*.

Meanwhile, since the thickness of the lever unit 16 is smaller than the (±Y direction) width of the first hole 2*a* for latching operation of the latch 16*a* and the insertion and release of the first hole 2*a*, even if two lever units 16 are used, there may be a little gap inside the first holes 2*a*. For this reason, the fixation of the connector body 11 in the Y-axis direction may be somewhat incomplete compared to the fixation in the X-axis and Z-axis directions.

Figure 9:
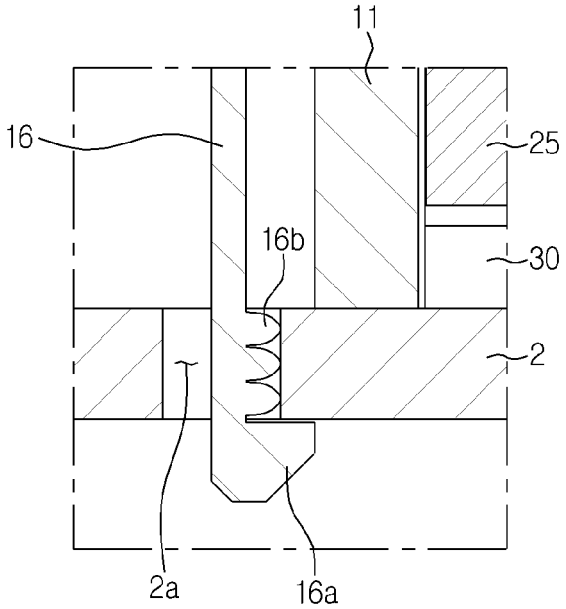
FIG. 9 is a diagram corresponding to FIG. 7 and showing a modified embodiment of the lever unit of this embodiment.

FIG. 9 is a diagram corresponding to FIG. 7 and showing a modified embodiment of the lever unit 16 of this embodiment.

The lever unit 16 according to this modified embodiment may additionally include a embossing pattern 16*b* in a portion of the lever unit 16 disposed in the first hole 2*a* of the PCB substrate 2 in the same direction as the latching direction of the latch 16*a*. When the lever unit 16 is inserted into the first hole 2*a* and latched to the other surface of the PCB substrate 2, the embossing pattern 16*b* of the lever unit 16 is brought into contact with the side surface inside the first hole 2*a*, thereby eliminating the gap in the first holes 2*a* as in the former embodiment. In this case, even if only two latch units 12 are used, the connector body 11 may be fixed to the substrate 2 not to move in X-axis, Y-axis and Z-axis directions.

As shown in FIGS. 4 and 5, the lock pin portion 18 protrudes in a lower direction (−Z-axis direction) from the lower end 11*a* of the connector body, which is in contact with one surface of the PCB substrate 2 by a length corresponding to the thickness of the PCB substrate 2, and is fitted into and engaged with the second hole 2*b* of the PCB substrate 2.

The lock pin portion 18 not only guides the mounting direction of the connector housing 10 to the PCB substrate 2 but also suppresses the movement of the connector body 11 in the X-axis and Y-axis directions by being fitted into the second hole 2*b* of the PCB substrate 2. In particular, the lock pin portion 18 enhances the fixation of the connector body 11 in the Y-axis direction, which is insufficient just with the latch units 12.

In particular, the lock pin portion 18 according to this embodiment is provided at the lower end of the connector body 11 located in a direction intersecting with both outer side surfaces of the connector body and is positioned at a location forming an equilateral triangular structure with the latch units 12. In the example of FIGS. 4 and 5, the lock pin portion 18 forms an isosceles triangle with the latch units, whereby the lock pin portion 18 is equidistant from two latch units 12 to equally absorb the load acting on two latch units 12.

As mentioned above, due to the gap between the first hole 2*a* and the lever unit 16, the fixation of the connector body 11 in the ±Y-axis direction is somewhat incomplete compared to other directions. However, since the lock pin portion 18 is fitted into the second hole 2*b* in the direction intersecting with the lever units 16, there is no gap with the second hole 2*b*. Thus, the lock pin portion 18 may reinforce the fixation of the connector body 11 in the ±Y-axis direction, which is insufficient only with the latch units 12, and absorb the load in the X-axis and Y-axis directions when an external force is applied to the connector body 11, thereby preventing the latch units 12 from being damaged.

Figure 10:
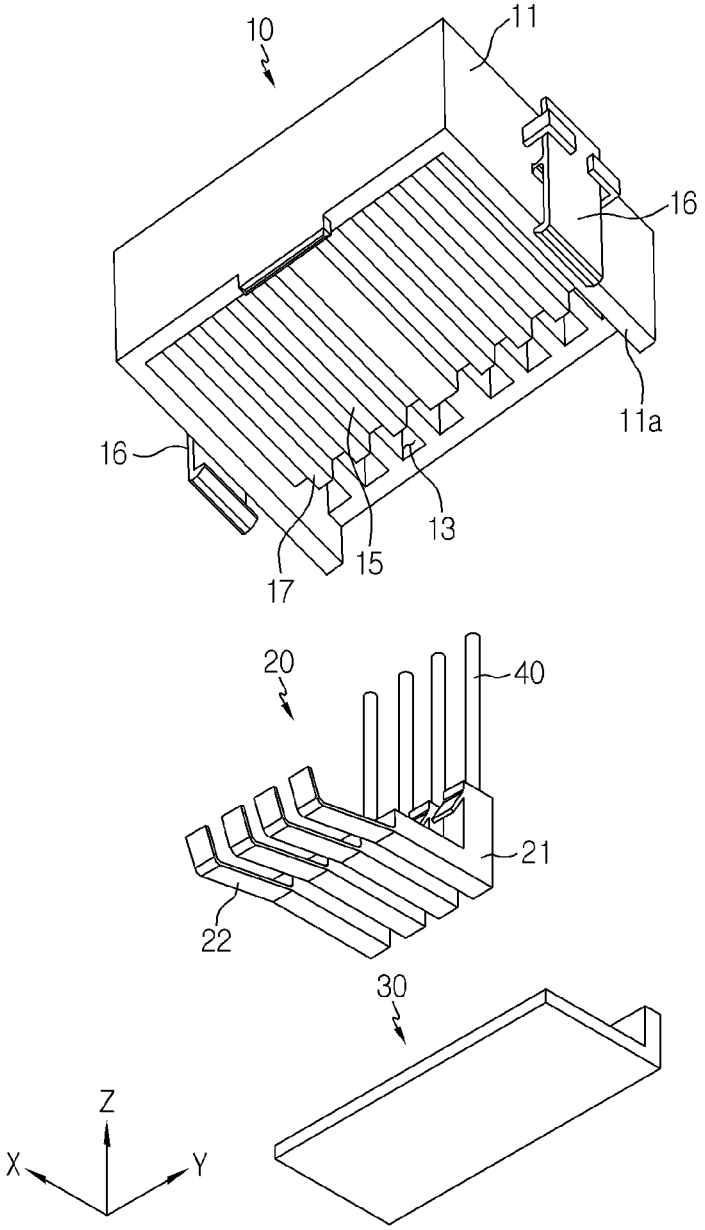
FIG. 10 is an exploded perspective view showing the vertical-type PCB connector according to an embodiment of the present disclosure.
Figure 11:
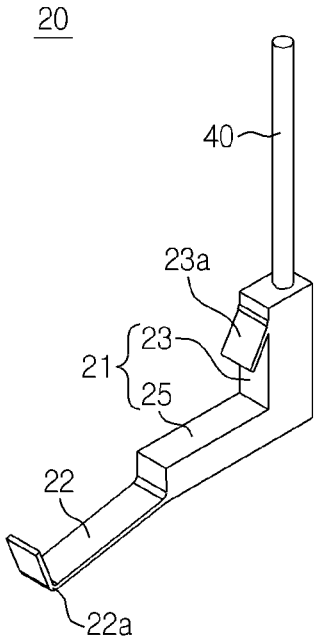
FIG. 11 is a perspective view showing a terminal member of FIG. 10.
Figure 12:
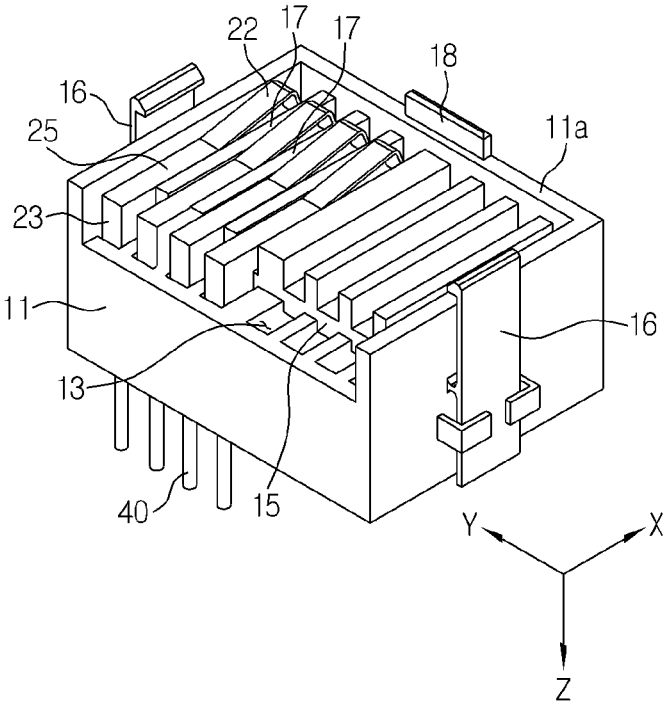
FIG. 12 is a perspective view showing that the terminal members are assembled to a connector housing according to an embodiment of the present disclosure.

FIG. 10 is an exploded perspective view showing the vertical-type PCB connector according to an embodiment of the present disclosure, FIG. 11 is a perspective view showing the terminal member 20 of FIG. 10, and FIG. 12 is a perspective view showing that the terminal members 20 are assembled to the connector housing 10 according to an embodiment of the present disclosure.

As shown in the figures, the bending terminal members 20 are inserted into the connector body 11 in the upper direction from the lower part of the connector body 11. Also, one side of the bending terminal members 20 extends in the first direction corresponding to a direction orthogonal to one surface of the PCB substrate 2 and is connected to a signal transmission cable 40, and the other side of the bending terminal members 20 extends in the second direction corresponding to the length direction of the contact pads 3 provided to one surface of the PCB substrate 2 to be able to contact the corresponding contact pads 3.

More specifically, as shown in FIG. 11, the bending terminal member 20 may include a terminal body 21 having mechanical rigidity to be easily assembled with the connector body 11, and a terminal contact 22 having elasticity for stable contact between the terminal body 21 and the contact pad 3 of the PCB substrate 2.

The terminal body 21 includes a vertical portion 23 extending in the first direction in a block shape and having a block shape with a predetermined thickness, and a horizontal portion 25 intersecting with the vertical portion 23 and extending in the second direction.

In addition, the terminal contact 22 has a smaller thickness than the horizontal portion 25 and is provided in a cantilever type extending in the second direction from an end of the horizontal portion 25. Also, the terminal contact 22 includes a contact portion 22*a* curved toward the contact pad 3 of the PCB substrate 2.

In order to accommodate the bending terminal members 20, as shown in FIGS. 5 and 10 along with FIG. 12, the connector body 11 may further include an inside plate 15 for dividing the inner space of the connector body 11 in a direction (the X-axis and Y-axis directions) intersecting with the first direction, and perforation holes 13 provided at locations adjacent to one side end of the inside plate 15 and forming tunnels inside the connector body 11 in the first direction at predetermined intervals.

In addition, the inside plate 15 may further include barriers 17 protruding in a direction (−Z-axis direction) opposite to the first direction with a predetermined interval therebetween. The interval between the barriers 17 is identical to the width of the horizontal portion 25 of the terminal body 21.

The inside plate 15 of this embodiment has a width somewhat smaller than the internal width of the connector body 11 along the ±X-axis direction, and the perforation holes 13 are provided between one side end of the inside plate 15 and the rear surface of the connector body 11.

In addition, the inside plate 15 is provided at a predetermined distance from the level at the lower end of the connector body 11 in the first direction (+Z-axis direction). Here, the predetermined distance is within a range where the contact portion of the terminal contact 22 is capable of contacting at least the contact pad 3 of the PCB substrate 2 when the connector housing 10 is mounted onto one surface of the PCB substrate 2.

In the bending terminal member 20, the terminal body 21 including the vertical portion 23 and the horizontal portion 25 has a substantially "L" shape. Thus, as shown in FIGS. 5 and 12, if the vertical portions 23 are respectively inserted into the corresponding perforation holes 13 of the connector body 11 to a predetermined depth, the horizontal portions 25 are disposed in contact with the inside plate 15.

In addition, the vertical portion 23 may further include an anti-separation pin 23*a*. The anti-separation pin 23*a* is directed opposite to the first direction (in the −Z-axis direction) and protrudes obliquely to form an acute angle with the vertical portion 23. As shown in FIG. 5, when the vertical portion 23 is inserted into the perforation hole 13, the anti-separation pin 23*a* may be disposed at a surface opposite to the surface where the horizontal portion 25 is in contact with the inside plate 15. Thus, since the anti-separation pin 23*a* is caught by the rear surface of the inside plate 15, the vertical portion 23 may not be easily separated from the perforation hole 13.

Moreover, a stopper 19 may be further provided in the perforation holes 13. The stopper 19 extends from the upper end of the connector body 11 toward the lower end thereof to support the end of the vertical portion 23. Also, a pin hole 13*a* communicating with the inside of the perforation hole 13 is further provided at the upper end of the connector body 11 with the stopper 19 being interposed therebetween. The vertical portion 23 may be pulled out of the perforation hole 13 by putting a jig into the pin hole 13*a* to press the anti-separation pin 23*a*.

The horizontal portions 25 of the bending terminal members 20 are disposed between the barriers 17 of the inside plate 15. In this case, a creepage distance between the horizontal portion 25 and the terminal contact 22 extending from the end of the horizontal portion 25 may be kept constant by the barriers 17, thereby preventing a short circuit between the terminals.

The terminal contact 22 is a cantilever type extending in the second direction (+X-axis direction) from the end of the horizontal portion 25 and has a curved contact portion to elastically contact the contact pad 3 of the PCB substrate 2. For example, at least the contact portion 22*a* of the terminal contact 22 is provided to protrude outer than the lower end 11*a* of the connector body so that the elastic restoring force is applied toward the contact pad 3 when the connector housing 10 is mounted onto one surface of the PCB substrate 2.

As shown in FIGS. 4 and 5, the retainer 30 is a component supporting the terminal body 21 at a lower portion of the bending terminal members 20 and may be mounted to the lower end of the connector body 11, for example, in a snap-fit manner although not shown in detail. The bending terminal members 20 inserted into the connector body 11 may be fixed in the vertical direction by the inside plate 15, the stopper 19, the anti-separation pin 23*a* and the retainer 30 and may be fixed in the horizontal direction by the perforation hole 13, the barrier 17 and the retainer 30.

If the vertical-type PCB connector according to an embodiment of the present disclosure is used, it is possible to directly connect the vertical-type PCB connector to one surface of the PCB substrate 2 without using a complementary connector, which is mounted to the PCB substrate 2 in the existing technique, thereby simplifying the structure and manufacturing process of the connector and reducing the manufacturing cost.

In addition, since the vertical-type PCB connector may be vertically mounted onto one surface of the PCB substrate 2, there is no restriction on the connection position as compared with the conventional edge connection-type connector for the substrate 2, thereby increasing the degree of freedom for space utilization of the PCB substrate 2 and remarkably reducing detachment or contact failure rate of the connector even with an external force due to excellent fixation of the connector.

The present disclosure has been described in detail. However, it should be understood that the detailed description and specific examples, while indicating preferred embodiments of the disclosure, are given by way of illustration only, since various changes and modifications within the scope of the disclosure will become apparent to those skilled in the art from this detailed description.

Meanwhile, when the terms indicating up, down, left and right directions are used in the specification, it is obvious to those skilled in the art that these merely represent relative locations for convenience in explanation and may vary based on a location of an observer or an object to be observed.

What is claimed is:

1. A vertical-type printed circuit board (PCB) connector, comprising:

a connector housing directly vertically mounted onto a first surface of a PCB substrate; and a plurality of bent terminal members positioned inside the connector housing, each terminal member being bent at a bend point and having:

a terminal body including a first portion extending from a bend point in a first direction corresponding to a direction perpendicular to the first surface of the PCB substrate, the first portion configured to be connected to a signal transmission cable, and a second portion extending from the bend point in a second direction corresponding to a length direction of contact pads formed on the first surface of the PCB substrate; and a cantilever-type terminal contact extending from the second portion of the terminal body in the second direction, the terminal contact configured to be connected to corresponding contact pad of the PCB substrate, wherein the cantilever-type terminal contact has a smaller thickness than the terminal body.

2. The vertical-type PCB connector according to claim 1, wherein the connector housing includes:

a connector body configured to accommodate the bent terminal members and disposed to contact the first surface of the PCB substrate; and first and second latch members positioned at opposing outer surfaces of the connector body, respectively, and vertically inserted into respective first holes formed in the PCB substrate to be latched to an opposing second surface of the PCB substrate.

3. The vertical-type PCB connector according to claim 2, wherein each of the first and second latch members includes:

a support protruding perpendicularly to the corresponding outer surface of the connector body; and a lever perpendicularly connected to the support and extending in a direction parallel to the corresponding outer surface of the connector body, the lever having a latch at a first end of the lever such that the latch is latched to the second surface of the PCB substrate through the corresponding first hole, wherein the lever is provided to perform a seesawing motion based on the support.

4. The vertical-type PCB connector according to claim 2, wherein the connector housing further includes a lock pin portion extending vertically at a lower end of the connector body, wherein the lock pin portion is configured to contact the first surface of the PCB substrate, and to fit into a second hole formed in the PCB substrate.

5. The vertical-type PCB connector according to claim 4, wherein the first latch member, the second latch member and lock pin portion are positioned such that straight lines drawn between central points of each form an isosceles triangular structure with the latch members.

6. The vertical-type PCB connector according to claim 2, wherein the terminal contact includes a contact portion curved toward the corresponding contact pad of the PCB substrate.

7. The vertical-type PCB connector according to claim 6, wherein the connector body includes:

an inside plate configured to divide an inner space of the connector body along a plane intersecting with the first direction; and a plurality of perforation holes provided at respective locations adjacent to a first side end of the inside plate, each perforation hole adapted to form a tunnel inside the connector body in the first direction, the tunnels formed by the plurality of perforation holes being spaced at predetermined intervals from each other, wherein the first portions of the terminal bodies of the plurality of bent terminal members are inserted into respective ones of the plurality of perforation holes, and the second portions of the terminal bodies of the plurality of bent terminal members are disposed in contact with a first surface of the inside plate.

8. The vertical-type PCB connector according to claim 7, wherein the inside plate includes a barrier disposed between the second portions of the terminal bodies of the plurality of bending terminal members.

9. The vertical-type PCB connector according to claim 7, wherein each bent terminal member further includes an anti-separation pin protruding in a direction opposite to the first direction, forming an acute angle with respect to the first portion of the terminal body of the bent terminal member, and disposed at an opposing second surface of the inside plate.

10. The vertical-type PCB connector according to claim 7, further comprising:

a retainer mounted to a lower end of the connector body and configured to support the plurality of terminal bodies of the bent terminal members.

* * * * *